US006583563B1

(12) United States Patent
Venkataramani et al.

(10) Patent No.: US 6,583,563 B1
(45) Date of Patent: Jun. 24, 2003

(54) CERAMIC DISCHARGE CHAMBER FOR A DISCHARGE LAMP

(75) Inventors: Venkat Subramaniam Venkataramani, Clifton Park, NY (US); Charles David Greskovich, Schenectady, NY (US); Curtis Edward Scott, Mentor, OH (US); James Anthony Brewer, Glenville, NY (US); Changlong Ning, Leicester (GB)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 09/250,634

(22) Filed: Feb. 16, 1999

Related U.S. Application Data

(63) Continuation-in-part of application No. 09/067,816, filed on Apr. 28, 1998.

(51) Int. Cl.[7] ..... H01J 17/16; H01J 61/30

(52) U.S. Cl. ..... 313/634; 313/623; 313/625; 313/626; 313/636

(58) Field of Search ..... 313/634, 623, 313/625, 626, 636, 493

(56) References Cited

U.S. PATENT DOCUMENTS

| | | | | |
|---|---|---|---|---|
| 3,907,949 A | * | 9/1975 | Carlson | 264/6 |
| 4,155,964 A | | 5/1979 | Aronow | |
| 4,285,732 A | | 8/1981 | Charles et al. | |
| 4,530,808 A | | 7/1985 | Renlund et al. | |
| 4,551,496 A | | 11/1985 | Renlund et al. | |
| 4,649,003 A | | 3/1987 | Hashimoto et al. | |
| 4,708,838 A | | 11/1987 | Bandyopadhyay et al. | |
| 4,799,601 A | | 1/1989 | Saito et al. | |

(List continued on next page.)

FOREIGN PATENT DOCUMENTS

| | | |
|---|---|---|
| EP | 0181223 | 5/1986 |
| EP | 587238 A1 | 1/1993 |

(List continued on next page.)

OTHER PUBLICATIONS

Ogbemi O. Omatete et al., *Gelcasting—A New Ceramic Forming Process*, 70 American Ceramic Society Bulletin No. 10 (1991).

(List continued on next page.)

*Primary Examiner*—Frank G. Font
*Assistant Examiner*—Roy M Punnoose
(74) *Attorney, Agent, or Firm*—Toan P. Vo; Noreen C. Johnson

(57) ABSTRACT

A ceramic discharge chamber for a lamp, according to an exemplary embodiment of the invention, comprises a first member which includes a leg portion and a transition portion, wherein the leg portion and the transition portion are integrally formed as one piece from a ceramic material, and a second member which includes a body portion, wherein the body portion is bonded to the transition portion of the first member. The ceramic discharge chamber can be formed by injection molding a ceramic material to form the first member, the first member forming a first portion of the ceramic discharge chamber; and bonding the first member to a second member which forms a second portion of the ceramic discharge chamber. The members which form the ceramic discharge chamber can greatly facilitate assembly of the discharge chamber, because the discharge chamber can be constructed with only one or two bonds between the members. The reduction in the number of bonds has the advantages of expediting assembly of the discharge chamber, reducing the number of potential bond defects during manufacturing, and reducing the possibility of breakage of the discharge chamber at a bond region during handling. One or more of the members may also include a radially directed flange which allows the members to be precisely aligned during assembly to improve the quality of the lamp.

16 Claims, 8 Drawing Sheets

U.S. PATENT DOCUMENTS

| | | | | | |
|---|---|---|---|---|---|
| 5,030,397 | A | | 7/1991 | Bandyopadhyay et al. | |
| 5,340,510 | A | | 8/1994 | Bowen | |
| 5,426,343 | A | * | 6/1995 | Rhodes et al. | 313/623 |
| 5,427,051 | A | | 6/1995 | Maxwell et al. | |
| 5,451,553 | A | | 9/1995 | Scott et al. | |
| 5,468,168 | A | | 11/1995 | Balaschak et al. | |
| 5,487,353 | A | | 1/1996 | Scott et al. | |
| 5,532,552 | A | * | 7/1996 | Heider et al. | 313/623 |
| 5,588,992 | A | | 12/1996 | Scott et al. | |
| 5,683,949 | A | | 11/1997 | Scott et al. | |
| 6,004,503 | A | | 12/1999 | Neil | 264/632 |

FOREIGN PATENT DOCUMENTS

| | | |
|---|---|---|
| EP | 0827177 | 3/1998 |
| JP | 60081757 | 5/1985 |
| JP | 10064481 | 3/1998 |
| WO | 9628839 | 3/1995 |

OTHER PUBLICATIONS

S. Carleton et al., *Metal Halide Lamps with Ceramic Envelopes: A Breakthrough in Color Control*, J. of Illuminating Eng. Soc. 139–145 (Winter 1997).

M.J. Edirisinghe and J.R.G. Evans, *Systematic Development of the Ceramic Injection Molding Process*, A 109 Materials Science and Engineeering 17–26 (1989).

Alexander Dobrusskin, Review of Metal Halide Lamps, 4th Int'l. Symp. on Sci. and Tech. of Light Sources, (1986).

* cited by examiner

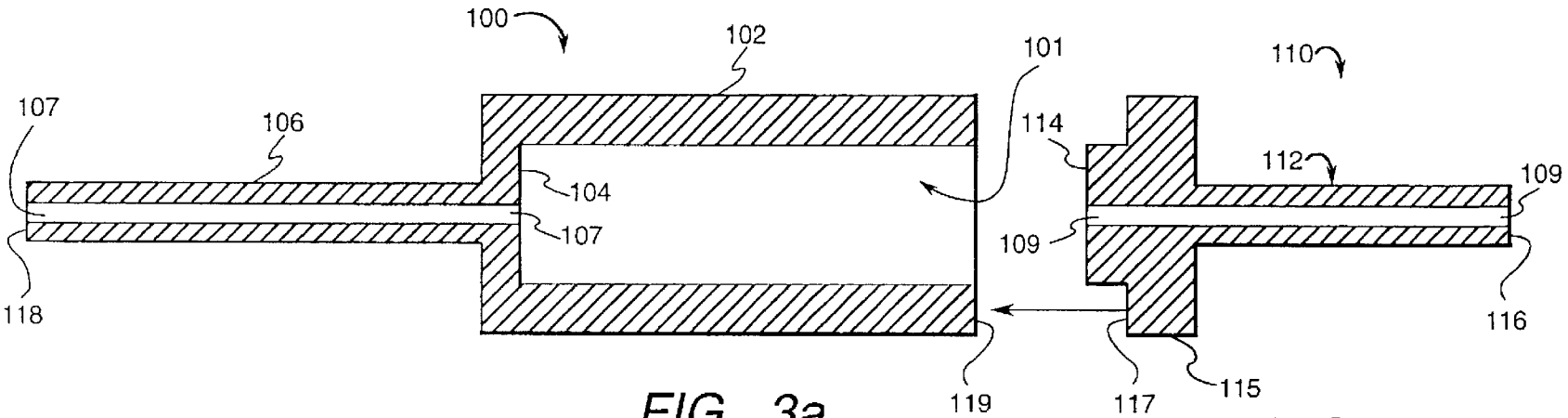
FIG. 3a
FIG. 3b
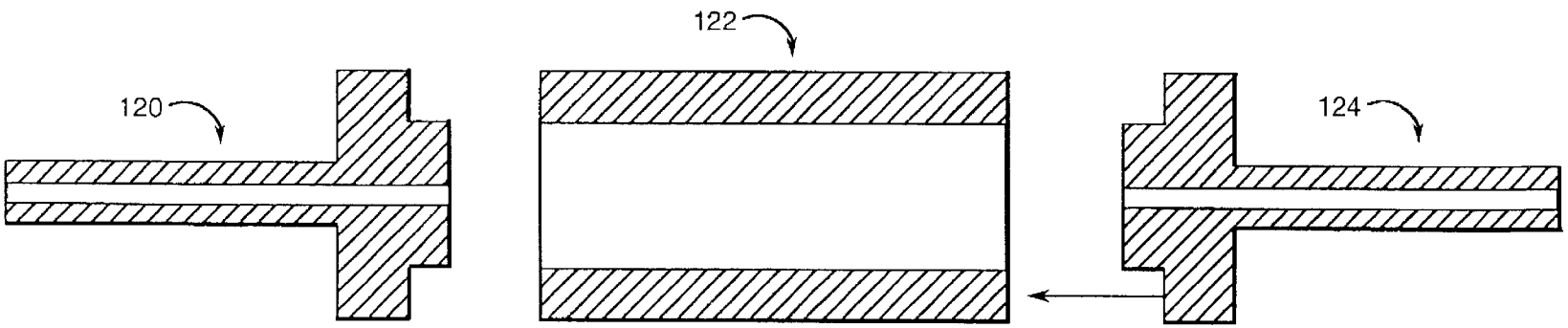
FIG. 4a
FIG. 4b
FIG. 4c

CERAMIC DISCHARGE CHAMBER FOR A DISCHARGE LAMP

This application is a continuation-in-part of U.S. Ser. No. 09/067,816, filed Apr. 28, 1998, which is hereby incorporated by reference in its entirety.

BACKGROUND

1. Field of the Invention

The present invention relates generally to lighting, and more particularly to a ceramic discharge chamber for a discharge lamp, such as a ceramic metal halide lamp.

2. Description of the Related Art

Discharge lamps produce light by ionizing a filler material such as a mixture of metal halides and mercury with an electric arc passing between two electrodes. The electrodes and the filler material are sealed within a translucent or transparent discharge chamber which maintains the pressure of the energized filler material and allows the emitted light to pass through it. The filler material, also known as a "dose", emits a desired spectral energy distribution in response to being excited by the electric arc. For example, halides provide spectral energy distributions that offer a broad choice of light properties, e.g. color temperatures, color renderings, and luminous efficacies.

Conventionally, the discharge chamber in a discharge lamp was formed from a vitreous material such as fused quartz, which was shaped into desired chamber geometries after being heated to a softened state. Fused quartz, however, has certain disadvantages which arise from its reactive properties at high operating temperatures. For example, in a quartz lamp, at temperatures greater than about 950–1000° C., the halide filling reacts with the glass to produce silicates and silicon halide, which results in depletion of the filler constituents. Elevated temperatures also cause sodium to permeate through the quartz wall, which causes depletion of the filler. Both depletions cause color shift over time, which reduces the useful lifetime of the lamp.

Although quartz lamps can be operated below 950° C. for increased lifetime, the quality of the light produced is compromised, because the light properties produced by the lamp depend on the operating temperature of the discharge chamber. The higher the temperature, the better the color rendering, the smaller the color spread lamp to lamp, and the higher the efficacy.

Ceramic discharge chambers were developed to operate at higher temperatures for improved color temperatures, color renderings, and luminous efficacies, while significantly reducing reactions with the filler material. European Patent Application No. 0 587 238 A1, for example, discloses a high pressure discharge lamp which includes a discharge chamber made of a ceramic such as translucent gastight aluminum oxide. Typically, ceramic discharge chambers are constructed from a number of parts which are extruded or die pressed from a ceramic powder. For example, FIGS. 1*a*–1*e* illustrate five parts which are used to construct a ceramic discharge chamber for a metal halide lamp. The two end plugs with a central bore in FIGS. 1*b* and 1*d* are fabricated by die pressing a mixture comprising a ceramic powder and an organic binder. The central cylinder (FIG. 1*c*) and the two legs (FIGS. 1*a* and 1*e*) are produced by extruding a ceramic powder/binder mixture through a die. Assembly of the discharge chamber involves the placement and tacking of the legs to the end plugs, and the end plugs into the ends of the central cylinder. This final assembly is then sintered to form four cosintered joints which are bonded by controlled shrinkage of the individual parts.

The conventional ceramic discharge chamber and method of construction depicted in FIGS. 1*a*–1*e*, however, have a number of disadvantages. For example, the number of component parts is relatively large and introduces a corresponding number of opportunities for variation and defects. Also, the convention discharge chamber includes four bonding regions, each of which introduces an opportunity for lamp failure by leakage of the filler material if the bond is formed improperly. Each bonding area also introduces a region of relative weakness, so that even if the bond is formed properly, the bond may break during handling or be damaged enough in handling to induce failure in operation.

Another disadvantage relates to the precision with which the parts can be assembled and the resulting effect on the light quality. It is known that the light quality is dependent to a substantial extent on the voltage across the electrode gap, which in turn is dependent upon the size of the gap. For example, in 70 watt metal halide lamp, a difference in 1 mm in the gap size produces a voltage difference of about 12–15 volts, which significantly affects the light quality. The number of parts shown in FIGS. 1*a*–1*e* makes it difficult to consistently achieve a gap size within an acceptable tolerance without significant effort devoted to optimizing the manufacturing process.

It would be desirable, therefore, to have a ceramic discharge chamber for a discharge lamp which could be manufactured precisely to achieve consistently high quality light, while reducing the opportunities for manufacturing defects to occur.

SUMMARY

A ceramic discharge chamber for a lamp, according to an exemplary embodiment of the invention, comprises a first member which includes a leg portion and a transition portion, wherein the leg portion and the transition portion are integrally formed as one piece from a ceramic material, and a second member which includes a body portion, wherein the body portion is bonded to the transition portion of the first member. The ceramic discharge chamber can be formed by injection molding a ceramic material to form the first member, the first member forming a first portion of the ceramic discharge chamber, and bonding the first member to a second member which forms a second portion of the ceramic discharge chamber. The second member may be an extruded cylinder to which is bonded a third member comprising another leg portion and transition portion. Alternately, the second member may comprise a body portion, a transition portion, and a leg portion.

The members which form the ceramic discharge chamber can greatly facilitate assembly of the chamber, because the discharge chamber can be constructed with only one or two bonds between the members. The reduction in the number of bonds also has the advantages of reducing the number of potential bond defects during manufacturing, and reducing the possibility of breakage of the discharge chamber at a bond region during handling. One or more of the members may also include a radially directed flange which allows the members to be precisely aligned during assembly to improve the quality of the lamp.

Exemplary embodiments of the invention can be used to improve the performance of various types of lamps, such as metal halide lamps, high pressure mercury vapor lamps, high pressure sodium vapor lamps, and white high pressure sodium lamps.

BRIEF DESCRIPTION OF THE DRAWINGS

Other features and advantages of the invention will be more readily understood upon reading the following detailed description, in conjunction with the drawings, in which:

FIGS. 3–18 illustrate various discharge chamber components according to exemplary embodiments of the invention.

DETAILED DESCRIPTION OF THE PREFERRED EMBODIMENTS

Figure 2:
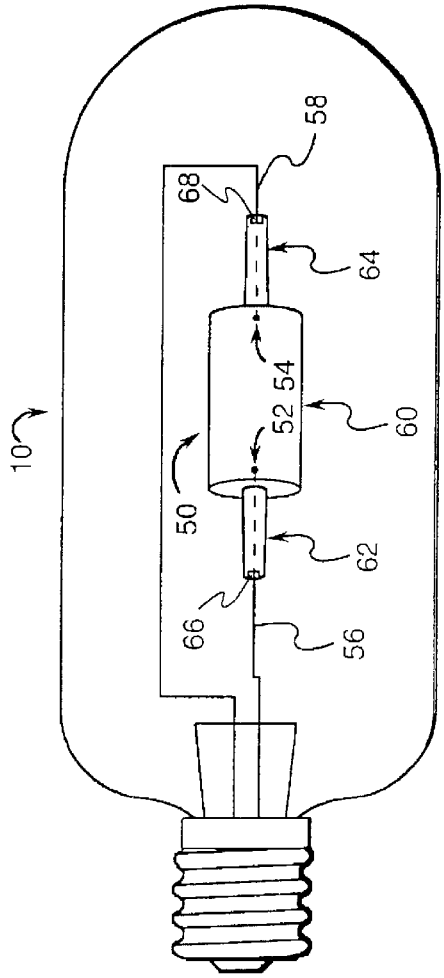
FIG. 2 illustrates a light source which includes a ceramic discharge chamber according to an exemplary embodiment of the invention.

FIG. 2 illustrates a discharge lamp 10 according to an exemplary embodiment of the invention The discharge lamp 10 includes a discharge chamber 50 which contains two electrodes 52, 54 and a filler material. The electrodes 52, 54 are connected to conductors 56, 58 which apply a potential difference across the electrodes. In operation, the electrodes 52, 54 produce an arc which ionizes the filler material to produce a plasma in the discharge chamber 50. The emission characteristics of the light produced by the plasma depend primarily on the constituents of the filler material, the voltage across the electrodes, the temperature distribution of the chamber, the pressure in the chamber, and the geometry of the chamber. For a ceramic metal halide lamp, the filler material typically comprises a mixture of Hg, a rare gas such as Ar or Xe, and a metal halide such as NaI, TlI or $DyI_3$. For a high pressure sodium lamp, the filler material typically comprises Na, a rare gas, and Hg. Other examples of filler materials are well known in the art. See, for example, Alexander Dobrusskin, Review of Metal Halide Lamps, 4th Annual International Symposium on Science and Technology of Light Sources (1986).

As shown in FIG. 2, the discharge chamber 50 comprises a central body portion 60 and two leg portions 62, 64. The ends of the electrodes 52, 54 are typically located near the opposite ends of the body portion 60. The electrodes are connected to a power supply by the conductors 56, 58, which are disposed within a central bore of each leg portion 62, 64. The electrodes typically comprise tungsten and are about 3–4 mm in length. The conductors typically comprise niobium and molybdenum which have thermal expansion coefficients close to that of alumina to reduce thermally induced stresses on the alumina leg portions 62, 64.

The discharge chamber 50 is sealed at the ends of the leg portions 62, 64 with seals 66, 68. The seals 66, 68 typically comprise a dysprosia-alumina-silica glass and can be formed by placing a glass frit in the shape of a ring around one of the conductors, e.g. 56, aligning the discharge chamber 50 vertically, and melting the frit. The melted glass then flows down into the leg 62, forming a seal between the conductor 56 and the leg 62. The discharge chamber is then turned upside down to seal the other leg 64 after being filled with the filler material. The leg portions 62, 64 are provided to lower the temperature of the seals 66, 68 during operation, e.g. to about 600° C., so that the filler material does not react with the glass seals 66, 68.

The leg portions 62, 64 extend axially away from the center of the discharge chamber 50. The dimensions of the leg portions 62, 64 are selected to lower the temperature of the seals 66, 68 by a desired amount with respect to the center of the discharge chamber 50. For example, in a 70 watt lamp, the leg portions have a length of about 10–15 mm, an inner diameter of about 0.8–1.0 mm, and an outer diameter of about 2.5–3.0 mm to lower the temperature at the seal 66, 68 to about 600–700° C., which is about 400° C. less than the temperature at the center of the discharge chamber. In a 35 watt lamp, the leg portions have a length of about 10–15 mm, an inner diameter of about 0.7–0.8 mm, and an outer diameter of about 2.0–2.5 mm. In a 150 watt lamp, the leg portions have a length of about 12–15 mm, an inner diameter of about 0.9–1.1 mm, and an outer diameter of about 2.5–3.0 mm. These dimensions, and others throughout the specification, are of course given as examples and are not intended to be limiting.

The body portion 60 of the discharge chamber is typically substantially cylindrical. For a 70 watt lamp, the body portion typically has an inner diameter of about 7 mm and outer diameter of about 8.5 mm. For a 35 watt lamp, the body portion typically has an inner diameter of about 5 mm and outer diameter of about 6.5 mm. For a 150 watt lamp, the body portion typically has an inner diameter of about 9.5 mm and outer diameter of about 11.5 mm.

FIGS. 3*a* and 3*b* illustrate two components of a discharge chamber according to a first exemplary embodiment of the invention. In FIG. 3*a*, a body member 100 is depicted which includes a body portion 102, a transition portion 104, and a leg portion 106. The transition portion 104 connects the relatively narrow leg portion 106 to the wider body portion 102, and may be generally in the shape of a disc. The leg portion 106 and the transition portion 104 both include a central bore 107 which houses the electrode and the conductor (not shown). The body portion 102 defines a chamber in which the electrodes produce a light-emitting plasma.

In FIG. 3*b*, the leg member 110 is depicted which includes a leg portion 112 and a transition portion 114. Both the leg portion 112 and the transition portion 114 include a central bore 109 which houses the second electrode and the conductor. The transition portion 114 may be generally in the form of a plug which fits inside the end of the body member 100. The transition portion 114 typically has a circumference which is greater than the circumference of the leg portion 112. The transition portion 114 typically includes a radially directed flange 115 which projects radially outwardly from the transition portion 114. The radially directed flange 115 provides a shoulder 117 which rests against the end 119 of the body member 100 during assembly to fix the relative axial position of the leg member 110 with respect to the body member 100. "Axial" refers to an axis through the central bores 107, 109 of the leg portions 106, 112.

The radially directed flange 115 provides the advantage that the total length of the assembled discharge chamber, e.g. measured from the end 118 of the body member 100 to the opposite end 116 of the leg member 110, can be maintained to within a tight dimensional tolerance. The total length of the discharge chamber typically affects the separation between the electrodes, since the electrodes are typically referenced to the ends 116, 118 of the leg portions 112, 106 during assembly. For example, the conductor may be crimped at a fixed distance from the end of the electrode, which crimp rests against the end of the leg portion to fix the axial position of the electrode with respect to the leg portion. Because the axial position of the electrodes is fixed with respect to the leg portions, the separation of the electrodes is determined by the position of the leg member 110 with respect to the body member 100, which can be precisely controlled by the radially directed flange 115.

The separation between the electrodes in turn affects the voltage drop across the electrodes, which can have a significant effect on the quality of light produced. The radially directed flange 115 thus allows the electrodes to be consistently positioned to have a precise separation distance, which improves the consistency and quality of the light produced. By contrast, in the conventional design of FIGS.

Figure 1E:
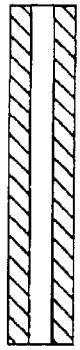
FIG. 1e Prior Art
FIGS. 1*a*–1*e* illustrate components of a conventional discharge chamber for a metal halide lamp.
Figure 1D:
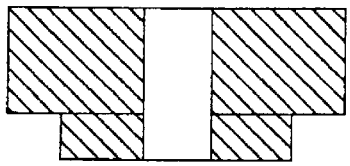
FIG. 1d Prior Art
Figure 1C:
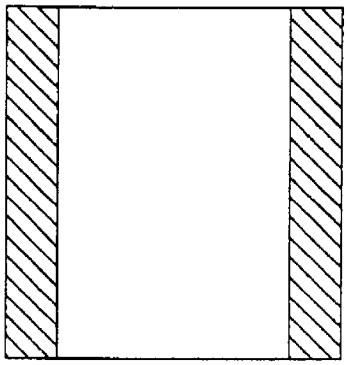
FIG. 1c Prior Art
Figure 1B:
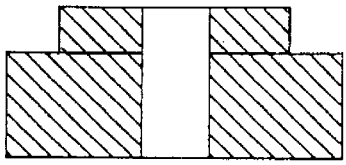
FIG. 1b Prior Art
Figure 1A:
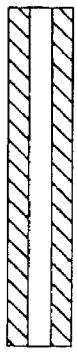
FIG. 1a Prior Art

1*a*–1*e* which includes five individual parts, the relative axial position of the legs (FIGS. 1*a*, 1*e*) is subject to variation during assembly, because there is no mechanism to fix the relative axial position of the legs.

To quantify the advantage of the radially directed flange 115, standard deviations were calculated for the total length of 30 randomly selected conventional discharge chambers (FIGS. 1*a*–1*e*) and the total length of 30 randomly selected discharge chambers assembled from the components shown in FIGS. 4*a*–4*c*. The standard deviation for the total length of the conventional discharge chamber was +/−0.22 mm, whereas the standard deviation for the total length of discharge chambers assembled from the components of FIGS. 4*a*–4*c* was +/−0.06 mm. These length variations translate into voltage standard deviations of 3.3 volts for the conventional design and only 0.9 volts for the design shown in FIGS. 4*a*–4*c*.

Referring again to FIGS. 3*a* and 3*b*, the body member 100 and the leg member 110 are each preferably formed as a single piece of a ceramic material such as alumina, rather than being assembled from a number of sub-parts. In this way, there are no bond regions between the various portions of the body member 100 and the leg member 110. For example, there is preferably no bond region between the leg portion 106 and the transition portion 104, or between the transition portion 104 and the body portion 102 of the body member 100. Similarly, there is preferably no bond region between the leg portion 112 and the transition portion 114 of the leg member 110.

The exemplary body and leg members 100, 110 shown in FIGS. 3*a* and 3*b* can greatly facilitate manufacturing of the discharge chamber, since the body member 100 includes a leg portion 106, a transition portion 104, and a body portion 102 formed as a single piece, and the leg member 110 includes a leg portion 112, a transition portion 114, and a radially directed flange 115 formed as a single piece. The components shown in FIGS. 3*a* and 3*b* allow the discharge chamber to be constructed with a single bond between the leg member 110 and the body member 100, whereas the five conventional components of the discharge chamber shown in FIGS. 1*a*–1*e* require four bonds to be made. The reduction in the number of bonds has the advantages of expediting assembly of the discharge chamber, reducing the number of potential bond defects during manufacturing, and reducing the possibility of breakage of the discharge chamber at a bond region during handling.

The body member 100 and the leg member 110 can be constructed by die pressing a mixture of a ceramic powder and a binder into a solid cylinder. Typically, the mixture comprises 95–98% by weight ceramic powder and 2–5% by weight organic binder. The ceramic powder may comprise alumina ($Al_2O_3$) having a purity of at least 99.98% and a surface area of about 2–10 $m^2/g$. The alumina powder may be doped with magnesia to inhibit grain growth, for example in an amount equal to 0.03%–0.2%, preferably 0.05%, by weight of the alumina. Other ceramic materials which may be used include non reactive refractory oxides and oxynitrides such as yttrium oxide, lutecium oxide, and hafnium oxide and their solid solutions and compounds with alumina such as yttrium-aluminum-garnet and aluminum oxynitride. Binders which may be used individually or in combination include organic polymers such as polyols, polyvinyl alcohol, vinyl acetates, acrylates, cellulosics and polyesters.

A exemplary composition which has been used for die pressing a solid cylinder comprises 97% by weight alumina powder having a surface area of 7 $m^2/g$, available from Baikowski International, Charlotte, N.C. as product number CR7. The alumina powder was doped with magnesia in the amount of 0.1% of the weight of the alumina. The composition also comprised 2.5% by weight polyvinyl alcohol, available from GE Lighting as product number 115-009-018, and ½% by weight Carbowax 600, available from Interstate Chemical.

Subsequent to die pressing, the binder is removed from the green part, typically by thermal pyrolysis, to form a bisque-fired part. The thermal pyrolysis may be conducted, for example, by heating the green part in air from room temperature to a maximum temperature of about 900–1100° C. over 4–8 hours, then holding the maximum temperature for 1–5 hours, and then cooling the part. After thermal pyrolysis, the porosity of the bisque-fired part is typically about 40–50%.

The bisque-fired part is then machined. For example, a small bore may be drilled along the axis of the solid cylinder which provides the bore 107 of the leg portion 106 in FIG. 3*a*. Next a larger diameter bore may be drilled along a portion of the axis to form the chamber 101. Finally, the outer portion of the originally solid cylinder may be machined away along part of the axis, for example with a lathe, to form the outer surface of the leg portion 106. The leg member 110 of FIG. 3*b* may be formed in a similar manner by first drilling a small bore which provides the bore 109 through the leg portion 112, machining the outer portion of the originally solid cylinder to produce the leg portion 112, and machining the transition portion 114, leaving the radially directed flange 115.

The machined parts 100, 110 are typically assembled prior to sintering to allow the sintering step to bond the parts together. According to an exemplary method of bonding, the densities of the bisque-fired parts used to form the body member 100 and the leg member 110 are selected to achieve different degrees of shrinkage during the sintering step. The different densities of the bisque-fired parts may be achieved by using ceramic powders having different surface areas. For example, the surface area of the ceramic powder used to form the body member 100 may be 6–10 $m^2/g$, while the surface area of the ceramic powder used to form the leg member 110 may be 2–3 $m^2/g$. The finer powder in the body member 100 causes the bisque-fired body member 100 to have a smaller density than the bisque-fired leg member 110 made from the coarser powder. The bisque-fired density of the body member 100 is typically 42–44% of the theoretical density of alumina (3.986 $g/cm^3$), and the bisque-fired density of the leg member 110 is typically 50–60% of the theoretical density of alumina. Because the bisque-fired body member 100 is less dense than the bisque-fired leg member 110, the body portion 102 shrinks to a greater degree (e.g. 3–10%) during sintering than the transition portion 114 to form a seal around the transition portion 114. By assembling the two components 100, 110 prior to sintering, the sintering step bonds the two components together to form a discharge chamber.

The sintering step may be carried out by heating the bisque-fired parts in hydrogen having a dew point of about 10–15° C. Typically the temperature is increased from room temperature to about 1300° C. over a two hour period. Next, the temperature is held at about 1300° C. for about 2 hours. Next, the temperature is increased by about 100° C. per hour up to a maximum temperature of about 1850–1880° C. Next, the temperature is held at 1850–1880° C. for about 3–5 hours. Finally, the temperature is decreased to room temperature over about 2 hours. The inclusion of magnesia in the ceramic powder typically inhibits the grain size from growing larger than 75 microns. The resulting ceramic material comprises a densely sintered polycrystalline alumina.

According to another method of bonding, a glass frit, e.g. comprising a refractory glass, can be placed between the body member 100 and the leg member 110 which bonds the two components together upon heating. According to this method, the parts can be sintered independently prior to assembly.

The body member 100 and leg member 110 typically each have a porosity of less than or equal to about 0.1%, preferably less than 0.01%, after sintering. Porosity is conventionally defined as a unitless number representing the proportion of the total volume of an article which is occupied by voids. At a porosity of 0.1% or less, the alumina typically has a suitable optical transmittance or translucency. The transmittance or translucency can be defined as "total transmittance", which is the transmitted luminous flux of a miniature incandescent lamp inside the discharge chamber divided by the transmitted luminous flux from the bare miniature incandescent lamp. At a porosity of 0.1% or less, the total transmittance is typically 95% or greater.

According to another exemplary method of construction, the component parts of the discharge chamber are formed by injection molding a mixture comprising about 45–60% by volume ceramic material and about 55–40% by volume binder. The ceramic material can comprise an alumina powder having a surface area of about 1.5 to about 10 $m^2/g$, typically between 3–5 $m^2/g$. According to one embodiment, the alumina powder has a purity of at least 99.98%. The alumina powder may be doped with magnesia to inhibit grain growth, for example in an amount equal to 0.03%–0.2%, preferably 0.05%, by weight of the alumina.

The binder may comprise a wax mixture or a polymer mixture. According to one example, the binder comprises:

33⅓ parts by weight paraffin wax, melting point 52–58° C.;

33⅓ parts by weight paraffin wax, melting point 59–63° C.;

33⅓ parts by weight paraffin wax, melting point 73–80° C.;

The following substances are added to the 100 parts by weight paraffin wax:

4 parts by weight white beeswax;

8 parts by weight oleic acid;

3 parts by weight aluminum stearate.

The above paraffin waxes are available from Aldrich Chemical under product numbers 317659, 327212, and 411671, respectively.

In the process of injection molding, the mixture of ceramic material and binder is heated to form a high viscosity mixture. The mixture is then injected into a suitably shaped mold and subsequently cooled to form a molded part.

Subsequent to injection molding, the binder is removed from the molded part, typically by thermal treatment, to form a debindered part. The thermal treatment may be conducted by heating the molded part in air or a controlled environment, e.g vacuum, nitrogen, rare gas, to a maximum temperature, and then holding the maximum temperature. For example, the temperature may be slowly increased by about 2–3° C. per hour from room temperature to a temperature of 160° C. Next, the temperature is increased by about 100° C. per hour to a maximum temperature of 900–1100° C. Finally, the temperature is held at 900–1100° C. for about 1–5 hours. The part is subsequently cooled. After the thermal treatment step, the porosity is about 40–50%.

The bisque-fired parts are typically assembled prior to sintering to allow the sintering step to bond the parts together. Typically, the densities of the bisque-fired parts used to form the body member 100 and the leg member 110 are selected to achieve different degrees of shrinkage during the sintering step. The different densities of the bisque-fired parts may be achieved by using ceramic powders having different surface areas, for example.

Sintering of the bisque-fired parts typically reduces the porosity to less than 0.1%, and increases the total transmittance to at least 95%. The sintering step may be carried out by heating the bisque-fired parts in hydrogen having a dew point of about 10–15° C. Typically the temperature is increased from room temperature to about 1300° C. over a two hour period. Next, the temperature is held at about 1300° C. for about 2 hours. Next, the temperature is increased by about 100° C. per hour up to a maximum temperature of about 1850–1880° C. Next, the temperature is held at 1850–1880° C. for about 3–5 hours. Finally, the temperature is decreased to room temperature over about 2 hours. The inclusion of magnesia in the ceramic powder typically inhibits the grain size from growing larger than 75 microns. The resulting ceramic material comprises a densely sintered polycrystalline alumina.

According to one example, an article was formed from a mixture comprising 48% by volume alumina and 52% by volume binder. The alumina had a surface area of 3 $m^2/g$ and was doped with magnesia in the amount of 0.05% of the weight of the alumina. The wax binder described above was used. The article, which had a thickness of about 3 mm, was sufficiently translucent that when pressed against newsprint, the newsprint could be read without difficulty through the article.

Additional embodiments of the invention will now be described with reference to FIGS. 4–17. Each of the embodiments shown in FIGS. 4–17 can be formed as described above by injection molding, or by die pressing and machining. The components can be bonded together by sintering with controlled differential shrinkage, as described above. The porosity of the various components shown in FIGS. 4–17 after sintering is preferably less than 0.1%, and the total transmittance is preferably at least 95%, as described above. As with the embodiments of FIGS. 2–3, the embodiments of FIGS. 4–17 can be used with discharge lamps of conventional power outputs, such as 35, 70, and 150 watts.

FIGS. 4*a*–4*c* illustrate components of a discharge chamber formed from three components. The leg members 120, 124 in FIGS. 4*a* and 4*c* are substantially the same as the leg member 110 of FIG. 3*b*. In FIG. 4*b*, a body member 122 is shown which is substantially cylindrical. The body member 122 of FIG. 4*b* can be formed by injection molding or by die pressing and machining. The body member 122 can also be formed conventionally by extrusion. The composition used for extrusion may comprise, for example, 75% by weight alumina powder, 22% by weight of a water-soluble polyacrylamide, and 3% by weight of a stearate. The alumina powder may be doped with magnesia in the amount of 0.05% by weight of the alumina. The leg members 120, 124 are typically bonded to the body member 122 by sintering with preselected differential shrinkage, as described above.

Figure 5:
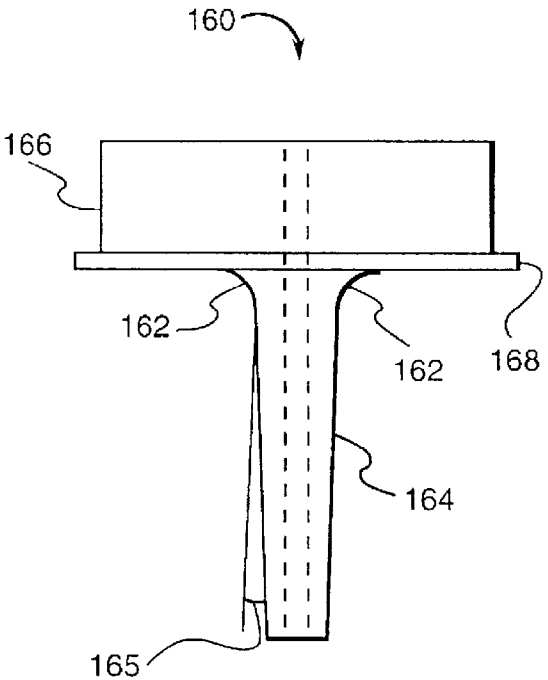

FIG. 5 illustrates a leg member 160 which may be bonded to a body member as shown in FIGS. 3*a* or 4*b*. In FIG. 5, the leg member 160 includes a curved portion 162 between the leg portion 164 and the transition portion 166. The curved portion 162 significantly increases the strength of the leg member, in particular, its resistance to breakage at the junction between the leg portion 164 and the transition portion 166. This feature is advantageous in substantially reducing the incidence of breakage in handling during assembly of the discharge chamber. The curved portion 162 typically has a radius of curvature of about 1–3 mm. FIG. 5 also illustrates that the leg portion 164 may be tapered slightly. For example, the angle indicated at 165 may be 1–2 degrees. The taper provides the advantage that the leg member may be easily removed from the mold after injection molding.

Figure 6:
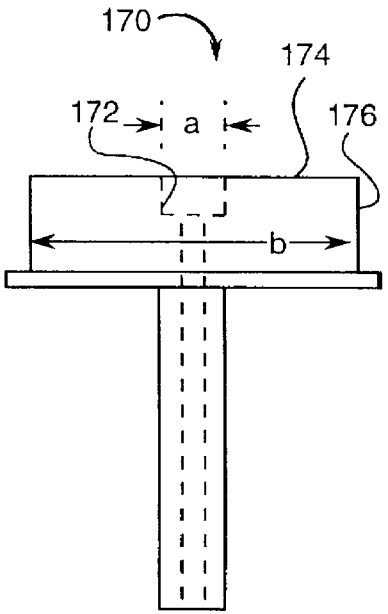

FIG. 6 illustrates another embodiment of the invention which includes a recess 172 on the inner side 174 of the transition portion 176. The recess 172, which is typically substantially cylindrical, is provided to capture reaction products, such as tungsten, produced at a tungsten electrode tip, for example, during operation of the lamp. By capturing reaction products in the recess 172, the majority of reaction products are prevented from reaching the walls of the body portion of the discharge chamber which decreases the lumens output of the lamp. The diameter "a" of the recess 172 is typically about 20–50% of the outer diameter "b" of the transition portion 174.

Figure 7:
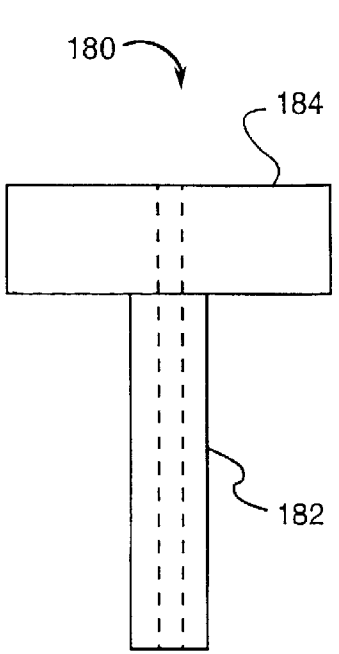

FIG. 7 illustrates a leg member 180 which includes a leg portion 182 and a transition portion 184. The leg member 180 is formed without a radially directed flange or a curved portion between the leg portion 182 and the transition portion 184.

Figure 8B:
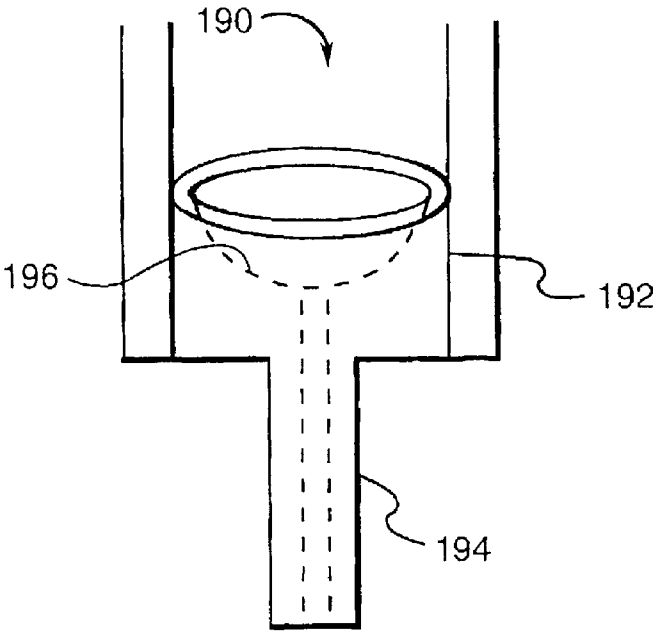
Figure 8A:
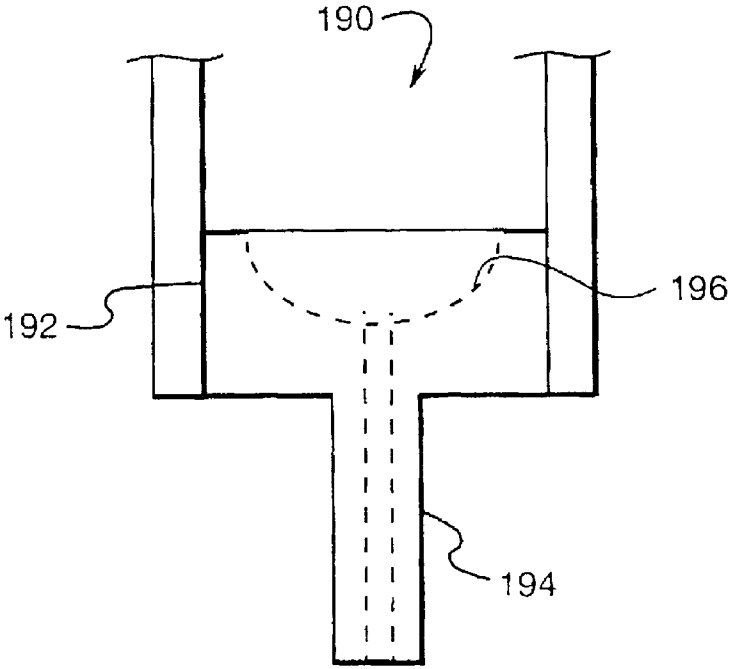

FIGS. 8*a* and 8*b* illustrate a cross section and a perspective view, respectively, of another embodiment of a leg member. The leg member 190 includes a transition portion 192 and a leg portion 194. The transition portion 192 has an outer surface which is substantially cylindrical. The transition portion 192 includes a recess 196 having a concave surface. The concave surface may be in the form of a portion of an ellipsoid or a cone, for example. When the leg member 190 is bonded to a body member, the inner surface of the assembled discharge chamber is rounded at the ends, rather than flat, which can improve the temperature distribution, light quality, and intensity produced by the discharge chamber. For example, the concave nature of the recess 196 can make the temperature distribution of the discharge chamber more uniform, which eliminates colder regions of the discharge chamber to improve the light quality.

Figure 9:
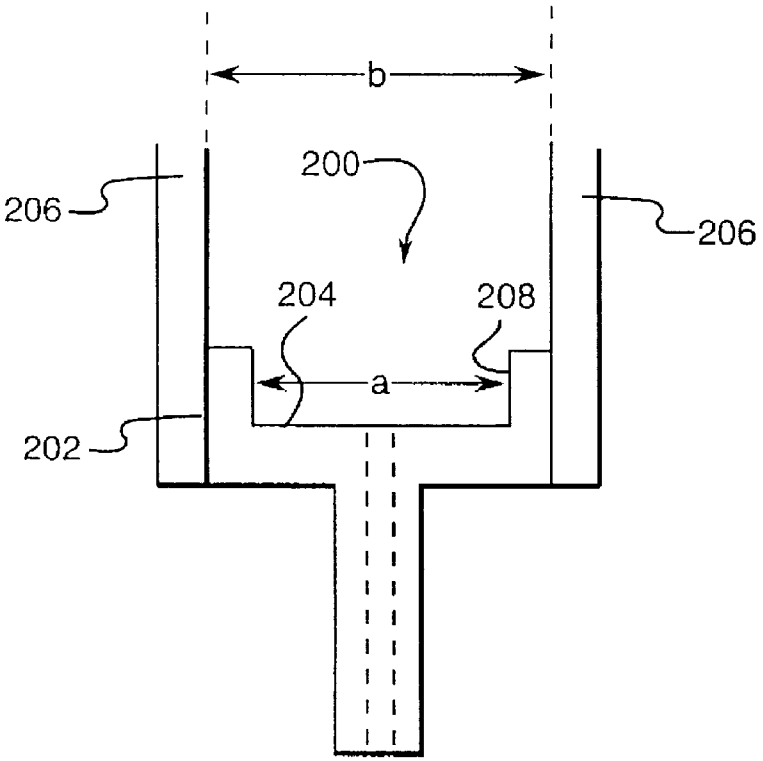

FIG. 9 illustrates a leg member 200 which includes a transition portion 202 having a cylindrical recess 204. The cylindrical recess has a relatively large diameter "a", for example about 50–80% of the outer diameter "b" of the transition portion 202. In forming the discharge chamber, the outer surface of the transition portion 202 is bonded to the inner surface of the body portion 206. The recess 204 provides a reservoir area for the filler material to reside during operation. Typically, a substantial portion of the filler material remains in a liquid phase during operation. By providing the recess 204 as a reservoir area, the liquid filler material is kept away from the body portion 206, which reduces reactions between the filler material and the relatively thin body portion 206, which increases the lifetime of the lamp. The recess 204 also reduces the thickness of the transition portion 202, allowing more light to pass through the transition portion in an axial direction.

Figure 10:
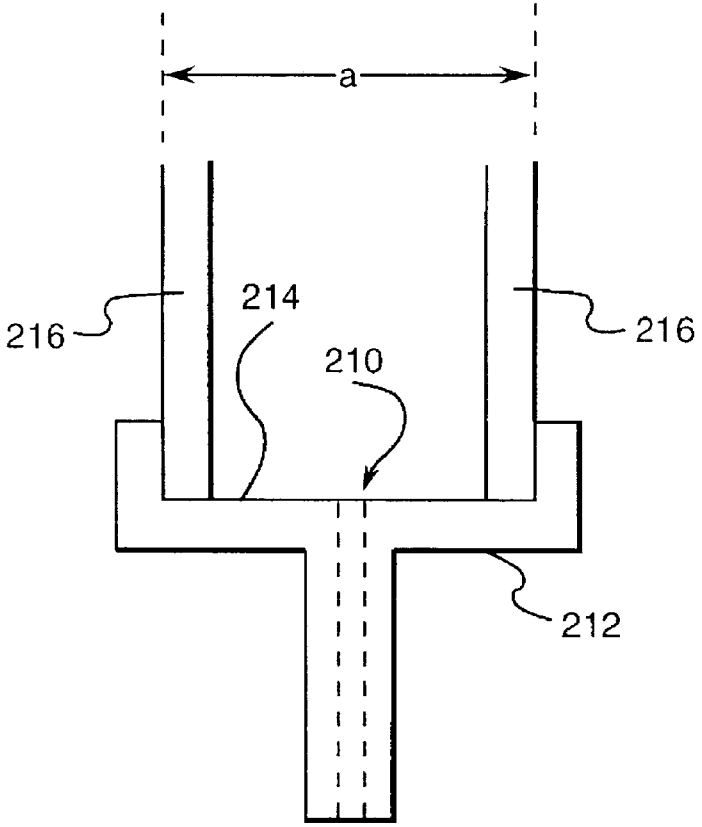

FIG. 10 illustrates a leg member 210 which includes a transition portion 212 having a cylindrical recess 214. The cylindrical recess 214 is configured such that the outside surface of the body member 216 is bonded to the inside surface of the recess 214. The leg member 210 can be configured to fit over body members 216 of conventional sizes. For example, the diameter "a" of the cylindrical recess 214 can be about 6.5 mm, 8.5 mm, or 11.5 mm which corresponds to the outer diameters of the cylindrical body portion for 35, 70, and 150 watt lamps, respectively.

Figure 11:
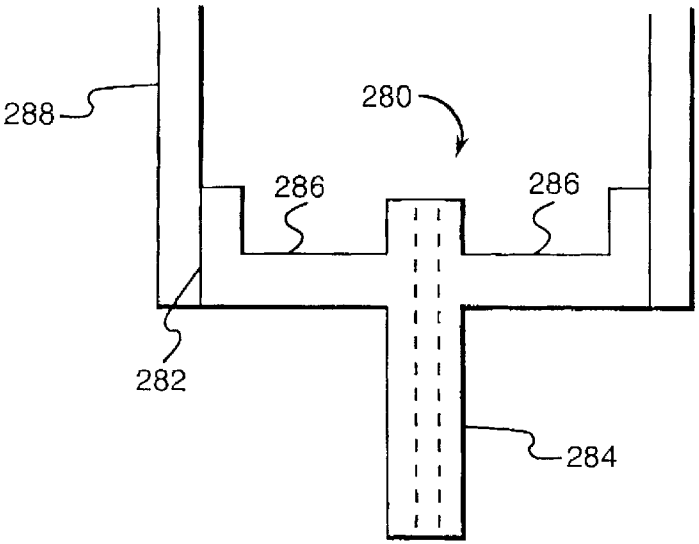

FIG. 11 illustrates a leg member 280 which includes a transition portion 282 and a leg portion 284. The transition portion 282 includes an annular recess 286. The annular recess 286 provides a reservoir area to keep the liquid filler material away from the relatively thin body portion 288 during operation to reduce reactions between the filler material and the body portion 288, which increases the lifetime of the lamp. The annular recess 286 also keeps the liquid filler material away from the electrode during operation. In addition, the recess 286 reduces the thickness of the transition portion 282, allowing more light to pass through the transition portion in an axial direction.

Figure 12:
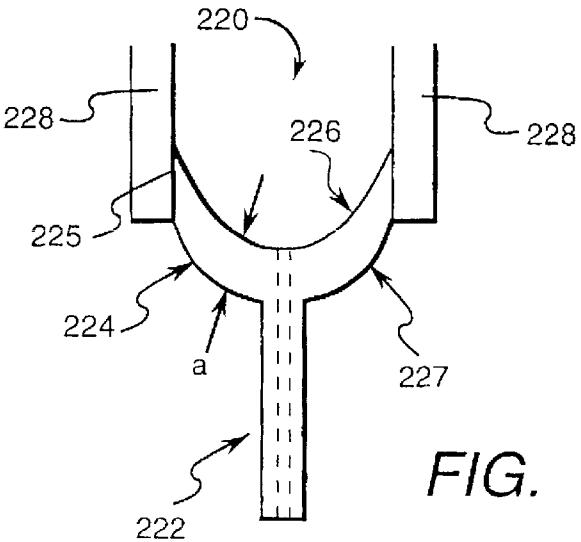

FIG. 12 illustrates a leg member 220 which includes a leg portion 222 and a transition portion 224. The transition portion 224 includes an outer cylindrical surface 225 which bonds with a body portion 228 to form a discharge chamber. The transition portion 224 also includes an inner curved surface 226 and an outer curved surface 227. The inner and outer curved surfaces 226, 227 are typically substantially in the form of an ellipsoid or cone. The thickness "a" of the transition portion 224 is typically about 1–2 mm. The shape of the leg member 220 can improve the thermal profile of the discharge chamber, resulting in a higher color temperature and improved light quality, for example.

Figure 13:
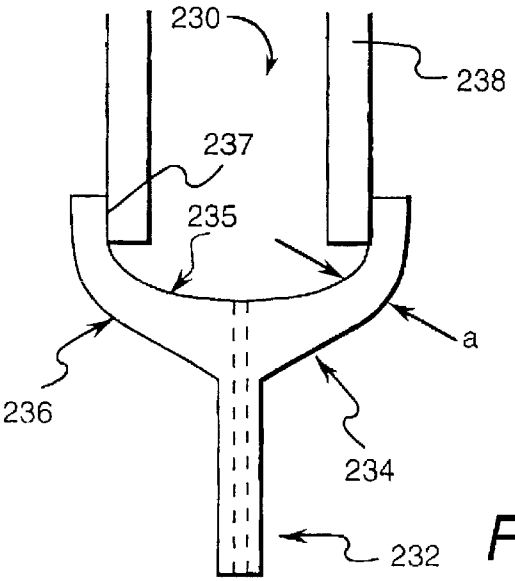

FIG. 13 illustrates a leg member 230 which includes a leg portion 232 and a transition portion 234. The transition portion 234 has a curved inner surface 235 and a curved outer surface 236. The inner and outer curved surfaces 235, 236 are typically substantially in the form of an ellipsoid or cone. The transition portion 234 also includes a cylindrical inner surface 237 which can be bonded to the outside of a body portion 238 to form a discharge chamber. The thickness "a" of the transition portion 234 is typically about 1–2 mm.

Figure 14:
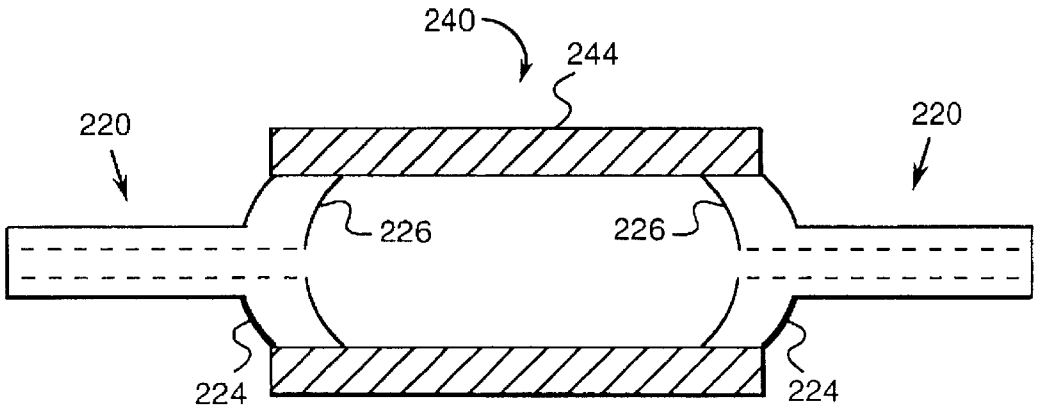

FIG. 14 illustrates a discharge chamber 240 formed of two leg members 220 from FIG. 12 and a body member 244. The body member 244 is typically substantially cylindrical, and can be formed by extrusion, for example.

Figure 15:
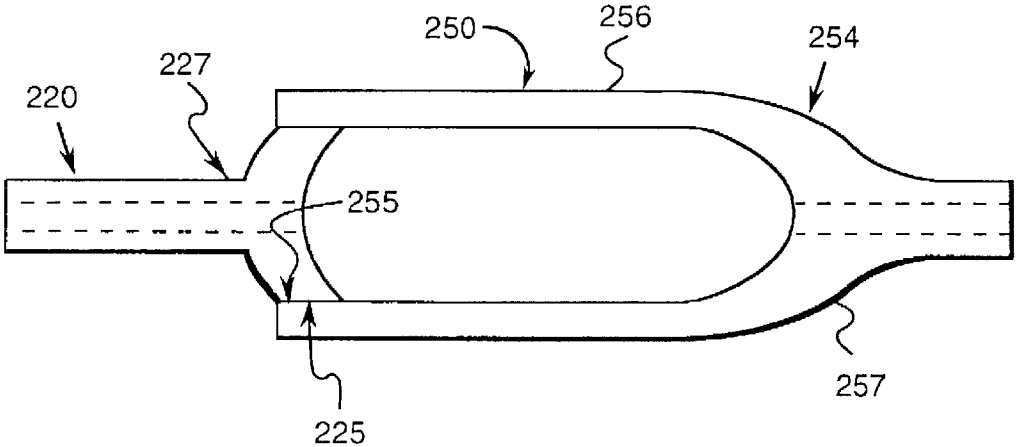

FIG. 15 illustrates a discharge chamber 250 which is formed from a leg member 220 of FIG. 12 and a body member 254. The body member 254 includes a curved transition portion 257 which typically has inner and outer curved surfaces in the form of an ellipsoid or cone. The body member 254 also includes a body portion 256 which may be substantially cylindrical. The outer cylindrical surface 225 of the leg member 220 is bonded to an inner cylindrical surface 255 of the body member 254. The discharge chamber 250 is formed from only two pieces 220, 254 with one bond between the cylindrical surfaces 253, 255.

Figure 17:
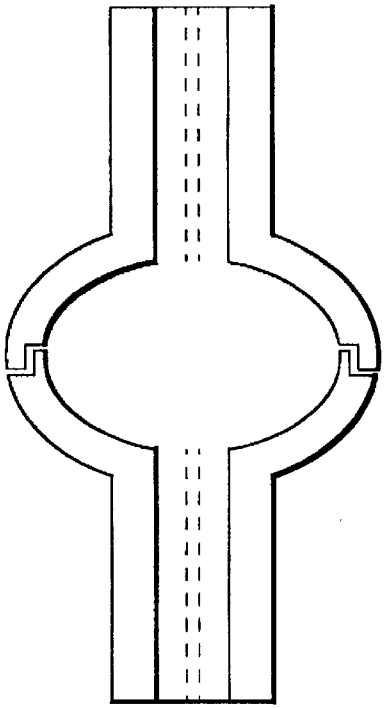
Figure 16:
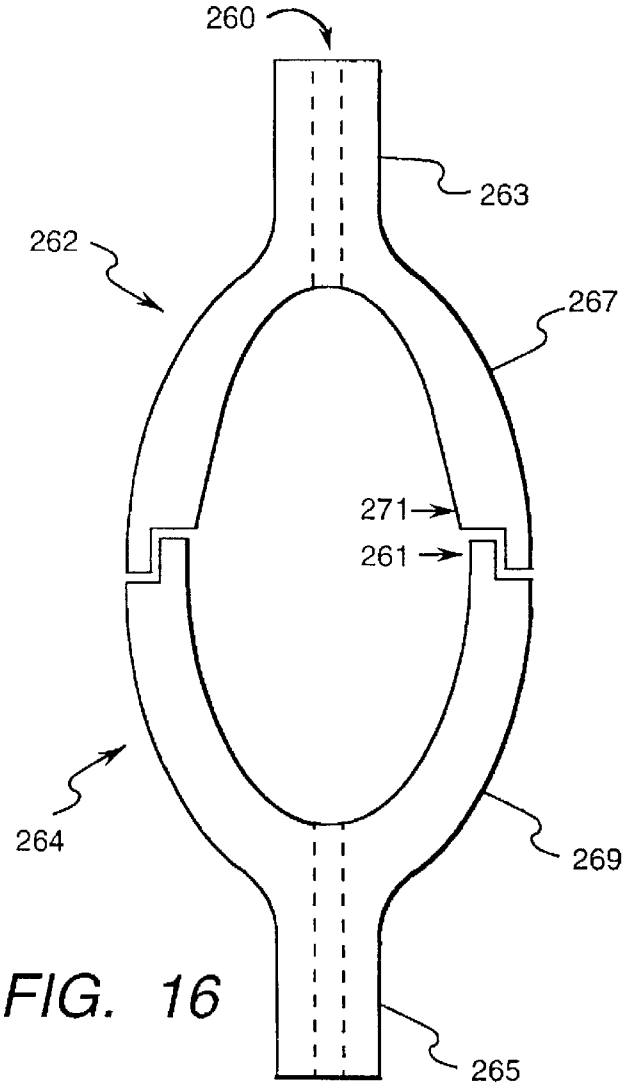

FIG. 16 illustrates a discharge chamber 260 which includes a first leg member 262 and a second leg member 264. The first and second leg members are of substantially the same shape, with the exception of stepped regions 261, 271. The stepped regions of the first and second leg members 262, 264 are complementary, so that the first and second leg members 262, 264 fit together. The first and second leg members 262, 264 have respective leg portions 263, 265 and transition portions 267, 269. The transition portions 267, 269 have inner and outer surfaces which are typically substantially in the form of an ellipsoid. In FIG. 16, the interior of the discharge chamber 260 is generally in the shape of an ellipsoid, with the legs aligned along the major axis of the ellipsoid. The discharge chamber shown in FIG. 17 is substantially the same as the discharge chamber of FIG. 16, with the exception that the legs are aligned along a minor axis of the ellipsoid. The embodiments shown in FIGS. 16 and 17 provide the advantage that the entire inner surface may closely approximate the shape of an ellipsoid.

Figure 18:
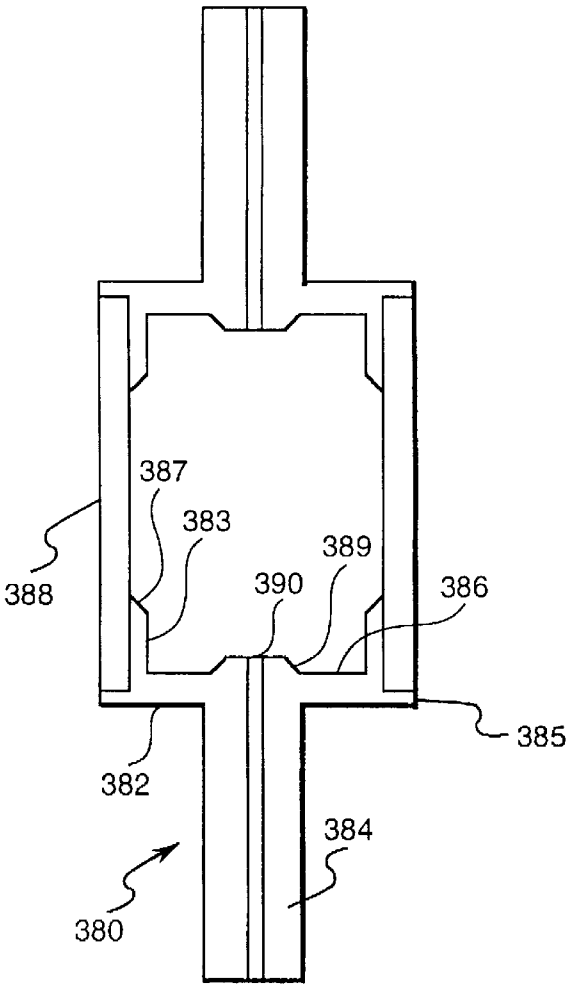

FIG. 18 illustrates a leg member 380 of similar overall configuration to that of FIG. 11. The leg member 380 includes a leg portion 384 and a transition portion 382, with an annular recess 386 in the transition portion. The leg member 380 is secured into the cylindrical body portion 388 by means of a cylindrical wall 383, the leg member being accurately located on the body portion in the axial direction by means of a flange 385 around the transition portion 382. The upper edge of the wall 383 has an upward taper 387, with the highest, outer, edge in contact with the inside of the body portion, so as to discourage any of the dose from settling around the junction between the wall 383 and the body portion. A shoulder 389 of the central part of the transition portion, which surrounds the electrode 390, is also tapered so as to encourage the dose away from the electrode, and into the annular recess 386.

Although the invention has been described with reference to exemplary embodiments, various changes and modifications can be made without departing from the scope and spirit of the invention. For example, the radially directed flange, the curved portion, and the tapered leg features shown in FIG. 5 can be applied in various combinations to the other embodiments shown in FIGS. 2–4 and 6–17. In addition, other methods of formation, such as gel casting or slip casting, may be utilized to form the various leg and body members. These and other modifications are intended to fall within the scope of the invention, as defined by the following claims.

What is claimed is:

1. A ceramic discharge chamber for a lamp, the ceramic discharge chamber comprising:

a hollow first member comprising a leg portion and a transition portion, the leg portion extending away from the transition portion, the transition portion forming a first-member first end, the leg portion terminating at a first-member second end, the transition portion having a larger outer circumference than an outer circumference of the leg portion, wherein the leg portion and the transition portion are integrally formed as one piece from a ceramic material; and a hollow second member having a second-member first end and a second-member second end, the second member comprising a body portion at the second-member first end;

wherein a portion of the transition portion having a length less than a whole length of the transition portion has an outer circumference adapted to fit inside the second-member first end, a remaining portion of the transition portion rests against and outside the second-member first end, and the body portion is bonded to the transition portion of the first member.

2. The ceramic discharge chamber of claim 1, wherein the first member is formed by injection molding.

3. The ceramic discharge chamber of claim 1, wherein the first and second members have a porosity of less than or equal to 0.1%.

4. The ceramic discharge chamber of claim 3, wherein the first and second members have a total transmittance of at least 95%.

5. The ceramic discharge chamber of claim 1, wherein said remaining portion of the transition portion comprises a radially directed flange which abuts an end of the body portion to fix a relative axial position of the leg portion with respect to the body portion.

6. The ceramic discharge chamber of claim 5, wherein the second member further comprises a second transition portion and a second leg portion, and the second transition portion, the second leg portion, and the body portion are integrally formed as one piece from a ceramic material.

7. The ceramic discharge chamber of claim 1, wherein the second member has a substantially uniform circumference, and the ceramic discharge chamber further comprises a third member, which is substantially the same as the first member and is bonded to the second-member second end.

8. The ceramic discharge chamber of claim 1, wherein the ceramic material comprises alumina.

9. The ceramic discharge chamber of claim 8, wherein the alumina has a surface area of 1.5–10 $m^2/g$, and the alumina is doped with magnesia in the amount of 0.03–0.2% by weight of the alumina.

10. The ceramic discharge chamber of claim 5, wherein the transition portion has an outer surface which is substantially cylindrical.

11. The ceramic discharge chamber of claim 10, wherein the transition portion includes a cylindrical recess opposite the radially directed flange.

12. The ceramic discharge chamber of claim 10, wherein the transition portion includes a recess having a concave surface.

13. The ceramic discharge chamber of claim 10, wherein the transition portion has an inner surface substantially in the form of an ellipsoid and an outer surface substantially in the form of an ellipsoid.

14. The ceramic discharge chamber of claim 6, wherein the transition portion of the first member and the second transition portion of the second member have concave surfaces which form a portion of the inner surface of the ceramic discharge chamber.

15. The ceramic discharge chamber of claim 1, wherein the ceramic discharge chamber includes a single bond region which is located between the transition portion of the first member and the body portion of the second member.

16. The ceramic discharge chamber of claim 7, wherein the ceramic discharge chamber includes only two bonds, a first bond between the transition portion of the first member and the body portion of the second member, and a second bond between the transition portion of the third member and the body portion of the second member.

* * * * *